United States Patent [19]

Mongagnino

[11] 4,193,590

[45] Mar. 18, 1980

[54] SHEET SEPARATOR AND FEEDING APPARATUS

[75] Inventor: James G. Mongagnino, Monroe, Conn.

[73] Assignee: Pitney Bowes Inc., Stamford, Conn.

[21] Appl. No.: 869,483

[22] Filed: Jan. 16, 1978

[51] Int. Cl.[2] ..... B65H 3/06

[52] U.S. Cl. ..... 271/119; 271/125; 271/165

[58] Field of Search ..... 271/109, 125, 124, 122, 271/121, 119, 120, 37, 38, 117, 118, 35, 165, 166

[56] References Cited

U.S. PATENT DOCUMENTS

| | | | |
|---|---|---|---|
| 549,111 | 11/1895 | Crowell | 271/118 |
| 600,844 | 3/1898 | Russell | 271/120 |
| 1,986,800 | 1/1935 | Elliott | 271/119 X |
| 2,907,567 | 10/1959 | Schneider et al. | 271/35 |
| 3,823,936 | 7/1974 | Quist | 271/118 |

*Primary Examiner*—Bruce H. Stoner, Jr.
*Attorney, Agent, or Firm*—Peter Vrahotes; William D. Soltow, Jr.; Albert W. Scribner

[57] ABSTRACT

A sheet separator and feeding apparatus is disclosed for feeding and separating sheets that vary in thickness from batch to batch. This is accomplished by providing an adjustable deck that changes the size of opening and entrance angle to the separator rollers. Additional exposure of the surface of the bump feed roller is also achieved.

2 Claims, 4 Drawing Figures

SHEET SEPARATOR AND FEEDING APPARATUS

BACKGROUND OF THE INVENTION

Sheet separating and feeding devices are well known in the art. Most devices are designed for separating and feeding sheets of a uniform thickness, as for example, devices that separate and feed computer cards, separators for supplying copy sheets in a photostatic copier, and devices that feed letters. There are times when it is necessary to feed sheets having non-uniform thickness, either the non-uniformity being within a single batch of sheets or the non-uniformity existing on a batch to batch basis, i.e., the sheets of a single batch having the same thickness but the thickness varies from batch to batch. This invention is concerned with the need to feed sheets whose thickness varies from batch to batch. Prior devices have attempted to solve the problem of varying sheet thickness from batch to batch by providing means for adjusting the distance between the separator roller and the bump feed roller. This is usually accomplished by spring loading the separator roller so that it will yield upon the feeding of sheets of different thicknesses. This practice has not been found totally acceptable because utilizing devices whose rollers separate as a result of sheet thickness has resulted in jams and multiple copies being conveyed on occasion.

SUMMARY OF THE INVENTION

It has been found that sheets may be fed successfully even though they may vary from batch to batch by providing an adjustable feed deck that has multiple position settings. This adjustment of the feed deck allows a physical change between the separator roller and bump roller through altering the amount of exposure of the bump roller and changing the entrance angle to the separator and bump roller. The latter has been found to be critically important.

DETAILED DESCRIPTION OF THE PREFERRED EMBODIMENT

Figure 1:
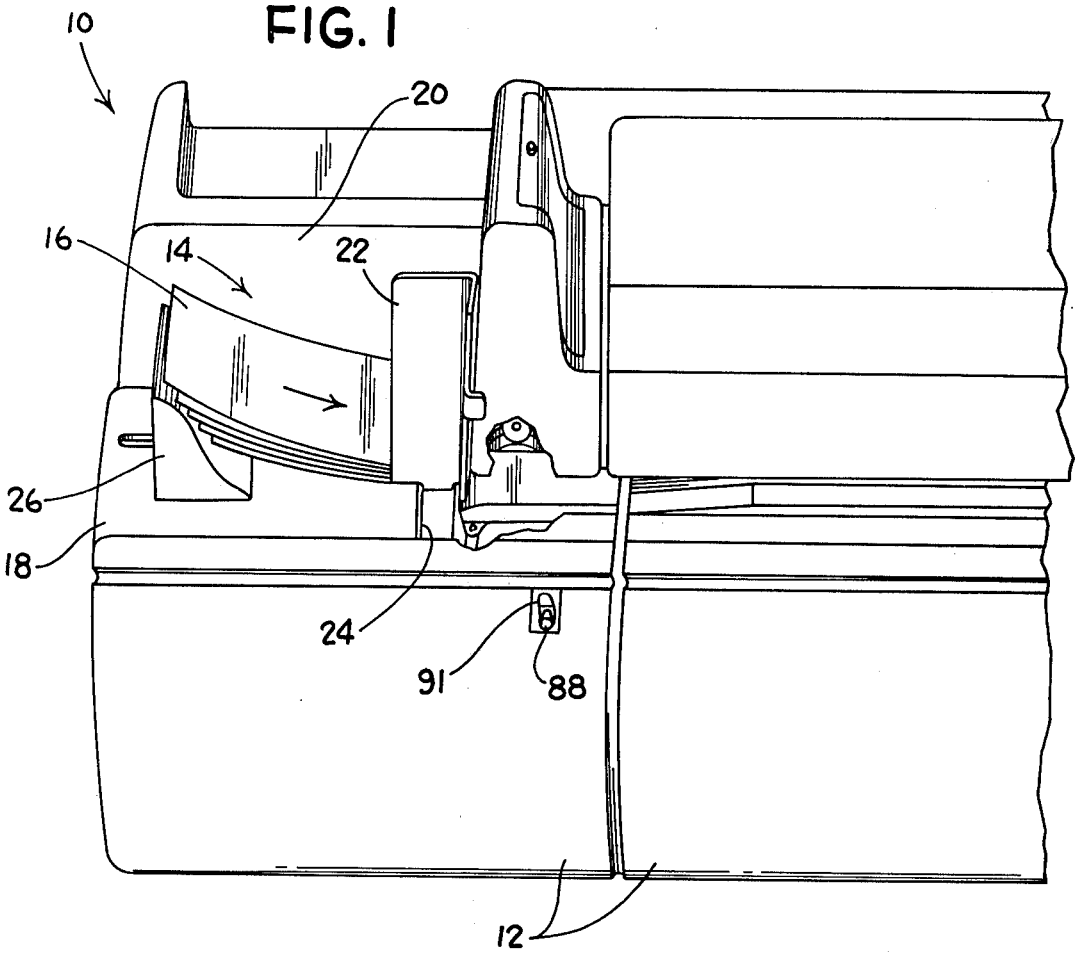
FIG. 1 shows a perspective view of an apparatus incorporating features of the instant invention.

Referring now to the drawing, a sheet separator and feeding apparatus is shown generally at 10 and has a housing 12 with a cover 13 thereover that supports a hopper 14 to which sheets 16 may be supplied. It will be appreciated that the term sheet is intended to include cards, documents, pages and other types of flat paper and paper-like articles. The hopper 14 is made up of a base plate 18, a side wall 20 and an adjustable panel 22 that is received within a channel 24 of the base plate 18. With this construction, sheets 16 of various width may be supplied to the hopper 14 and may be accommodated through the adjustment of the panel 22 within the channel 24. Any suitable means may be used to movably retain the panel within the channel 24 such as a force fit or detents.

Figure 4:
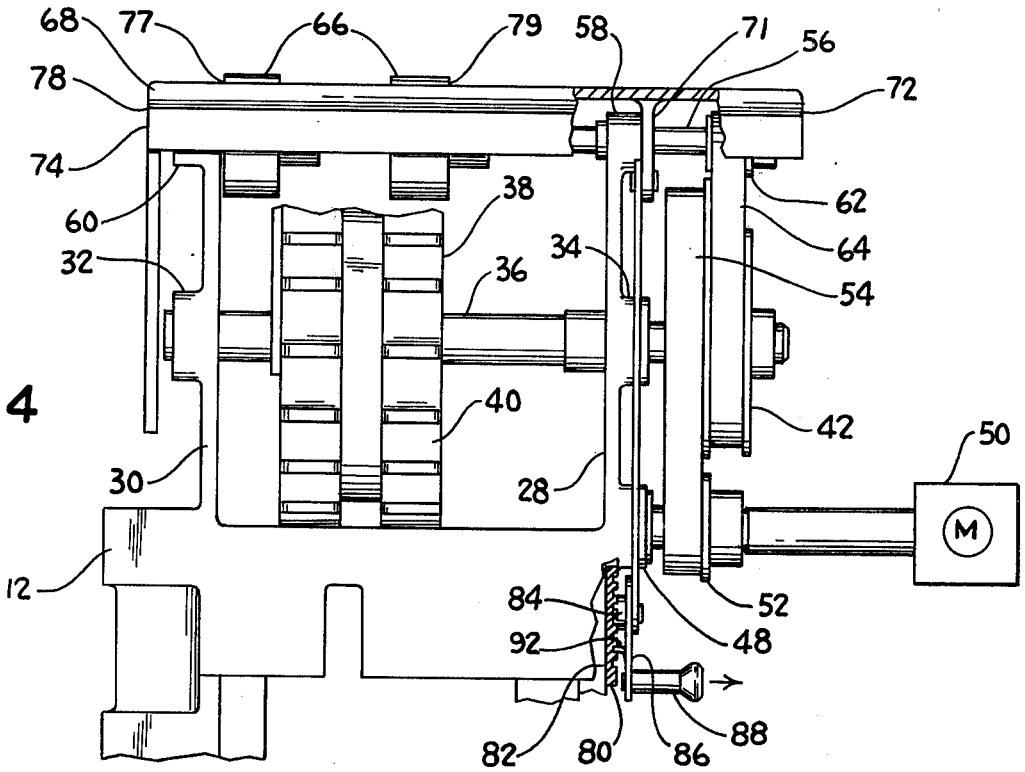
FIG. 4 is a cross sectional view taken along the lines 4—4 of FIG. 2, having portions cut away for clarity.
Figure 2:
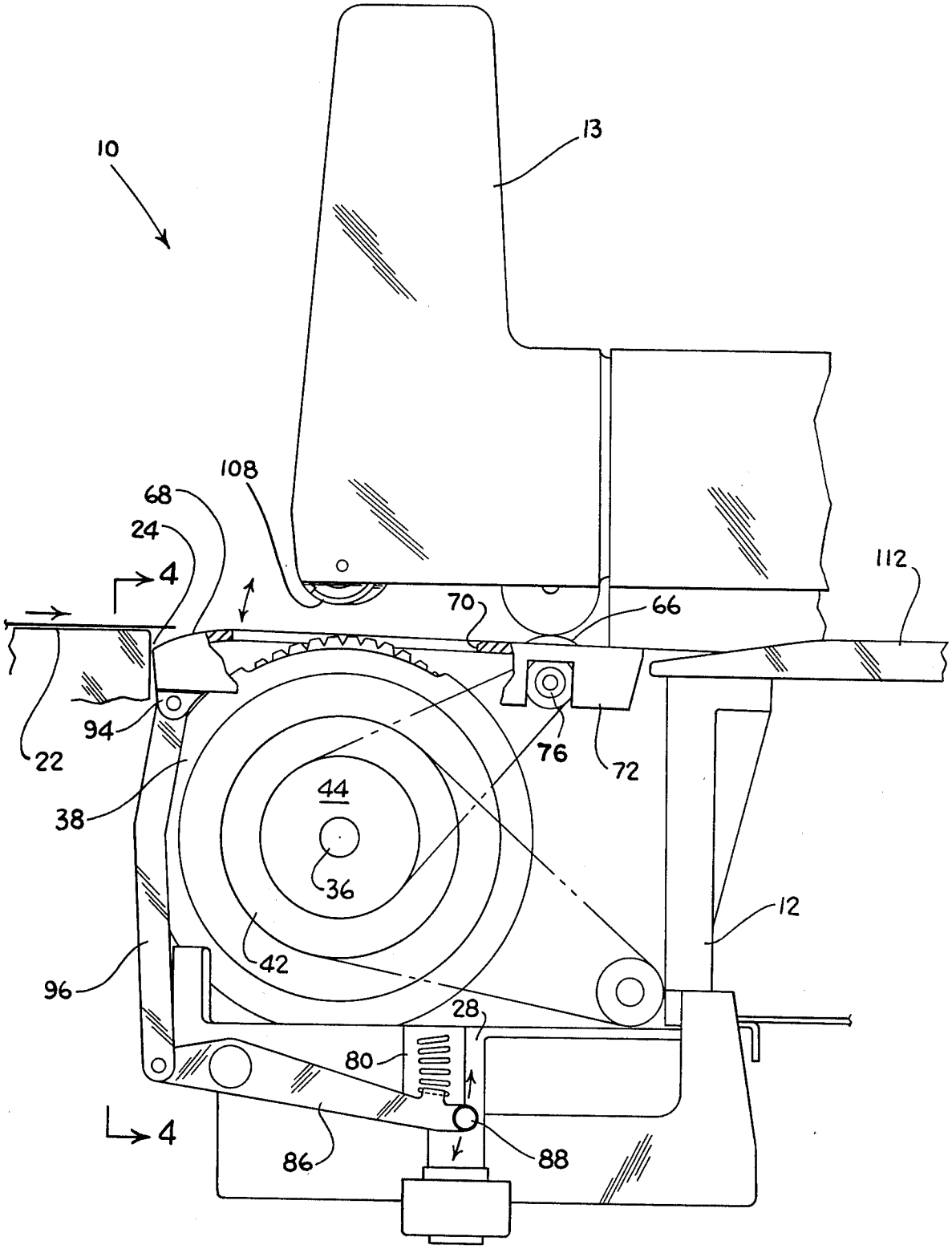
FIG. 2 shows a longitudinal, partially cross sectional view of a portion of the apparatus shown in FIG. 1.
Figure 3:
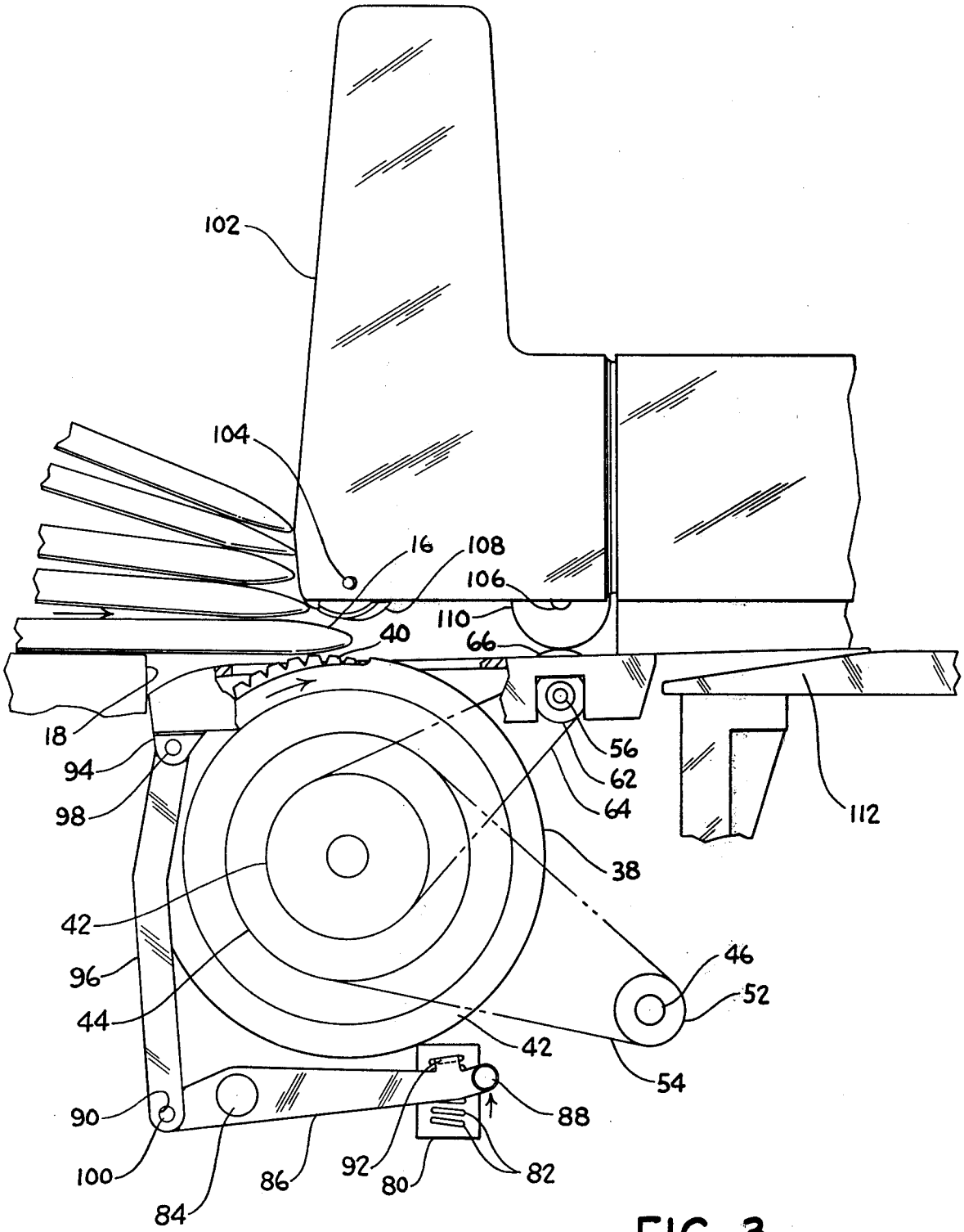
FIG. 3 is the same view as FIG. 2 but showing the apparatus in a different mode of operation.

Referring now to FIGS. 2–4, the housing 12 includes a pair of partitions 28 and 30, that are spaced relative to one another. Each of the partitions 28, 30 has a journal bearing 32, 34, respecitvely, that rotatably receive a shaft 36, a portion of which extends beyond the partition 28. Supported upon the shaft 36 for rotation therewith between the partitions 28, 30 is bump roller 38 having a grooved surface 40 over a portion of the perimeter thereof. A pair of pulleys 42, 44 are secured to the portion of the shaft 36 that extends beyond the partition 28. Another shaft 46 is received within a journal bearing 48 located in the parition 28 and extends to a motor 50 that provides drive to the shaft 46. A pulley 52 is secured to the shaft 46 and a belt 54 is trained about the pulleys 44, 52 to provide drive from the shaft 46 to the shaft 36. Another shaft 56 is received within journal bearings 58, 60 that are supported by the partitions 28, 30, respectively. A pulley 62 is secured to one end of the shaft 56 and a belt 64 is trained about the pulleys 42, 62 to provide drive from the shaft 36 to the shaft 56. A pair of rollers 66 is secured to the shaft 56 for rotation therewith. Attached to the shaft 56 is a deck 68 which has a central opening 70 therein. The deck 68 has a pair of depending edges 72, 74 that are located outside the partitions 28, 30 and each of the outside edges 72, 74 has a journal bearing 76, 78 respectively, that receives the shaft 56 therein. This allows the deck 68 to be pivotably supported by the shaft 56 while allowing the shaft to rotate. The deck 68 has a pair of openings 77, 79 through which the rollers 66 extend.

A plate 80 is supported upon the partition 28 and has a plurality of serrations 82 therein. A shaft 84 is received within the partition 28 and a line 86 is rotatably supported by the shaft 84. The link has a handle 88 at one end and an opening 90 at the opposite end. The handle 88 extends through an opening 91 in the cover 13 to make it accessible to an operator. The link 86 is made of a resilient metal so that the same may be moved laterally by manipulation of the handle 88. A finger 92 extends laterally from the link 86 to be received within a serration 82. The deck 68 has a lug 94 that depends therefrom. A link 96 extends from the lug 94 to the link 86, there being a pin 98 pivotly connecting the link 96 to the lug and another pin 100 piovtly connecting the link 96 to the link 86.

Disposed above the deck 68 is a gear housing 102 that has a pair of shafts 104 and 106 therein. The shaft 104 supports a separator roller 108 and a pair of rollers 110 is supported by the shaft 106, which pair of rollers 110 operatively engage the pair of rollers 66. Downstream from the pairs of rollers 66 and 110 is a platform 112.

In operation, sheets 16 are supplied to the hopper 14 to be separated and conveyed by the apparatus 10. Depending upon the thickness of the sheet 16, the operator will adjust the link 86 by pulling the handle away from the plate 80, rotating the link 86 about the shaft 84 and locating the finger 92 to any of the serrations 82 that may be required. Upon rotation of the link 86 about the pin 84 the link 96 will cause the deck 68 to rise or fall depending upon the direction of rotation of the link 86. With the lifting and lowering of the deck 68 the angle of the deck 68 will be changed relative to the hopper 14 and the amount of exposure of the surface 40 of the bump roller 38 will be increased or decreased depending upon whether the deck 68 is lifted or lowered. More specifically, when the link 86 is rotated in a clockwise direction as seen in FIGS. 2 and 3, the deck 68 will be lifted to thereby decrease the entrance angle and the amount of surface 40 exposed; whereas, when the link 86 is rotated in a counterclockwise direction the deck 86 will be lowered thereby increasing the entrance angle and exposing more of the surface 40 of the bump roller 38. Normally the separator roller 108 will be non-rotational and the distance betweenthe separator roller 108 and the bump roller 40 will be constant. It will be appreciated that the distance between the bump roller 38 and separator roller 108 may be varied if desired. It has been found, however, that the critical factor in the ability to separate documents of different thicknesses is the entrance angle of the deck 68. Additionally, it has also been found that the amount of surface 40 of the bumper roller exposed is another important factor. It will be appreciated that the stack of sheets 16 will engage the separator roller 108 and bump roller 42 and that the lower most sheet will be carried away by the bump roller to be conveyed to the take-away rollers 66, 110 to be conveyed to the plaform 112.

The bump roller 38 is truncated, i.e., only a portion of its perimeter has a grooved surface 40 that will contact the lowermost sheet 16 as the distance between the grooved surface and the roller 108 is less than the thickness of a sheet. The amount of perimeter having a grooved surface 40 is sufficient to drive the lowermost sheet 16 to the take-away rollers 66, 106 which will act upon the sheet to carry it further. At this point, the bump roller no longer acts upon the stack of sheets 16 because the distance between the balance of the bump roller and separator roller 108 is greater than the thickness of a sheet thereby mitigating the possibility of multiple sheets being conveyed together.

I claim:

1. A sheet separator and feeding apparatus comprising: a housing, a generally longitudinally disposed feed deck pivotably supported at one longitudinal end by said housing and having an opening therein, means for horizontally supporting said feed deck at the other longitudinal end, said supporting means including a first link rotatably supported within said housing, a second link having first and second ends, said first end being pivotably supported by said feed deck and said second end being pivotably attached to the first end of said first link and detent means supported by said housing and in engagement with the second end of said first link for holding said second end of said first link in a plurality of positions, a shaft rotatably received within said housing below said feed deck, a first roller secured upon said shaft and having a portion received within said opening, a second roller spaced relative to said first roller, said first and second rollers being in a generally common vertical plane, and means for rotating said shaft.

2. A sheet separator and feeding apparatus comprising: a housing, a generally longitudinally disposed feed deck pivotably supported at one longitudinal end by said housing and having an opening therein, means for horizontally supporting said feed deck at the other longitudinal end, means for adjusting the horizontal support means to position said feed deck at various angles relative to the horizontal, a shaft rotatably received within said housing below said feed deck, a bump roller having a grooved surface on a portion of its perimeter secured upon said shaft, a portion of said bump roller received within said opening, a second roller spaced relative to said bump roller, said bump roller and said second roller being in a generally common vertically plane, and means for rotating said shaft, said grooved surface being separated from said second roller a distance less than the thickness of a sheet to be conveyed when placed adjacent to said second roller by said rotating means and the balance of said bump roller perimeter being separated from said second roller a distance greater than the thickness of a sheet to be conveyed when placed adjacent to said second roller.

* * * * *